United States Patent [19]

Richmond

[11] 4,313,281

[45] Feb. 2, 1982

[54] GATE OPENING AND CLOSING APPARATUS AND METHOD

[76] Inventor: Moscow K. Richmond, 2819 Butler Ave., Los Angeles, Calif. 90064

[21] Appl. No.: 126,316

[22] Filed: Mar. 3, 1980

[51] Int. Cl.[3] ..... E05F 15/00

[52] U.S. Cl. ..... 49/280; 49/360; 49/139

[58] Field of Search ..... 49/360, 363, 280, 138; 192/93 R

[56] References Cited

U.S. PATENT DOCUMENTS 3,606,699 9/1971 Robinson, Sr. ..... 49/280

4,159,599 7/1979 Richmond ..... 49/463

*Primary Examiner*—Kenneth Downey

*Attorney, Agent, or Firm*—Robert J. Schaap

[57] ABSTRACT

An improved gate opening and closing apparatus which is designed to shift a gate from an opened position to a closed position and from the closed position to the opened position with respect to an access opening and which preferably shifts the gate in a linear path with respect to the access opening. The apparatus generally comprises a housing which may contain a gear drive along with a motor, such as an electric motor. The motor, through the gear drive, may rotate a drive member, such as a drive wheel, which is operatively connected to the motor and which drive member is capable of being operatively connected to a gate for causing shifting movement of the gate. The apparatus is also provided with a locking mechanism associated with the drive member to prevent movement of the gate when the motive means is not energized. In like manner, the locking mechanism is designed to automatically open or shift to the unlocked position when the motor is energized so that the drive member, powered by the motor, may cause the gate to shift between the open and closed positions. The apparatus further comprises a manually operable release member which is connected to the locking mechanism and to the drive member such that the manually operable release member when operated opens the locking mechanism and substantially simultaneously operatively disconnects the drive member from the motor. In this way, it is possible to override the drive mechanism in the event of an emergency condition such as a power failure or the like.

37 Claims, 12 Drawing Figures

GATE OPENING AND CLOSING APPARATUS AND METHOD

BACKGROUND OF THE INVENTION

1. Field of the Invention

This invention relates in general to certain new and useful improvements in gate-opening and closing apparatus and more particularly, to gate-opening and closing apparatus and methods therefore which shift a gate between an open and closed position and which also permits overriding by operatively disconnecting a drive member from a motive means as well as substantially simultaneously opening an automatic locking mechanism.

2. Brief Description of the Prior Art

In recent years, there have been a number of gate opening and closing assemblies and particularly, automatic type opening and closing assemblies. These gate assemblies have received increasing prominence in many commercial applications. There are several types of gates which are moved from a closed position to an open position in order to provide access and back to a closed position in order to provide a type of security. One type of gate is a gate which is slidable on a trackway, or other mechanism, for movement in a linear direction. This type of gate shifts from an open position in a linear path to a closed position in order to block the access opening. Other types of gates have one vertical side portion thereof hingedly mounted so that the other vertical side portion is swingable away from a stationary structure to an open position and back toward the stationary structure to a closed position.

As indicated previously, the automatic gate openers, in particular, have received increased prominence in recent years. These automatic gate openers may operate on the basis of a remote control mechanism such that a party desiring to open or close the gate does not have to physically engage the gate. For example, the gate opening and closing apparatus may use a radio transmitter and receiver system, such that a radio transmitter, when actuated, will generate a particular frequency signal which is sensed by the receiver to automatically operate the gate or door in order to open the same or close the same. In addition, and in many cases, the gates are controlled through key operated switch mechanisms, such that the user merely inserts a key into a key type switch and turns same to cause the completion of a circuit, thereby energizing or de-energizing a motor to permit movement of the gate.

With respect to the so-called "slider gates" that is gates which move in a generally linear path across the access opening, there have been significant problems in coupling these gate opening and closing apparatus to the sliding gate. One of the principal problems has been that the apparatus itself must be constructed so that it occupies only a small space and further, it must be capable of being located in a generally unobtrusive location.

Another one of the problems encountered with gates and the associated opening and closing apparatus is that of security. Typically, after the gate has been shifted to a closed position, there must be some type of positive locking action in order to prevent unauthorized opening of the gate. Finally, in the event of an emergency condition, such as a power failure, there must be some provision for overriding the entire apparatus so as to permit manual opening and closing of the gate.

In U.S. Pat. No. 4,159,599 dated July 3, 1979, by the same Applicant herein, there is provided a gate opening and closing assembly which is designed to shift a gate in a linear path between closed and open positions. This gate opening and closing assembly also used a drive motor along with a gear operable drive mechanism for rotating a pair of lever arms in order to shift a gate between the closed and open positions. A manually operable override mechanism was provided in this apparatus, although the override mechanism deals with the disengagement of a clutch.

The present invention obviates these and other problems in the provision of a gate opening and closing apparatus and method which automatically provides a positive locking action for a gate after the same has been shifted to a closed position and which is provided with an override means such that a drive member can be automatically disconnected from a motor and substantially simultaneously therewith the locking mechanism can be opened in order to permit emergency manual opening and closing of the gate.

OBJECTS OF THE INVENTION

It is, therefore, a primary object of the present invention to provide an improved gate-opening and closing apparatus having an override mechanism such that a drive member may be disconnected from a source of power and a locking mechanism can be substantially simultaneously opened upon actuation of an override mechanism thereof.

It is another object of the present invention to provide an apparatus of the type stated which includes a manually operable release mechanism mounted on one side of a drive housing and a drive member which permits coupling to a gate located on the other side of the housing and which thereby enables simple and rugged construction of the apparatus.

It is a further object of the present invention to provide an improved type of gate opening and closing apparatus of the type stated in which a drive shaft is utilized to rotate a drive member such as a drive wheel and an actuating shaft which is concentrically located with respect to the drive shaft so as to be axially displacable upon operation of an override mechanism and which permits axial shifting of the drive member out of engagement with the drive shaft.

It is an additional object of the present invention to provide a gate opening and closing apparatus of the type stated which utilizes a counting mechanism along with a control circuit in order to automatically control movement of the gate between the opened and closed positions.

It is still another object of the present invention to provide an improved gate-opening and closing apparatus of the type stated which can be manufactured at a relatively low unit cost and which is highly efficient and reliable in its operation.

It is still a further object of the present invention to provide an improved gate opening and closing apparatus of the type stated which is constructed so that it requires a minimum amount of space and further, can be mounted in a wide variety of positions relative to a gate so as to be unobtrusively located relative thereto.

It is another salient object of the present invention to provide a method of opening and closing a gate with a motive means along with an override system which automatically disconnects a drive member from the motor and substantially simultaneously opens a locking mechanism therefor.

With the above and other objects in view, my invention resides in the novel features of form, construction, arrangement, and combination of parts presently described and pointed out in the claims.

SUMMARY OF THE DISCLOSURE

An apparatus for shifting a gate from a closed position to an open position and from the open position back to the closed position with respect to an access opening. The apparatus generally comprises a housing along with a motive means, such as an electric motor, operatively associated with the housing. A drive member is operatively connected to the motive means and is capable of being connected to a gate for causing shifting movement of the gate. Typically the drive member is connected to the motive means by means of a drive shaft which extends through the housing.

The apparatus includes a locking mechanism which is operatively associated with the drive member for preventing shifting movement of the gate when the motive means is not energized. Moreover, the locking mechanism is adapted to be operated so that it is opened in order to permit movement of the gate when the motive means is energized.

The apparatus comprises a manually operable release member which is operatively connected to the locking mechanism and to the drive member. The release member functions as part of an override means and is capable of unlocking the locking mechanism and substantially simultaneously operatively disconnecting the drive member from the motive means, and more particularly disconnecting the drive member from the drive shaft.

In one embodiment of the invention, the locking mechanism uses a solenoid which is connected to a locking pin or locking rod. The solenoid is adapted to be energized essentially simultaneously with the energization of the motor so as to withdraw the locking rod from a locking position with the drive member, the latter preferably being a drive wheel. When the motor is de-energized, the solenoid is de-energized thereby permitting the locking rod to be moved into locking engagement with the drive wheel.

As indicated above, the drive wheel is effectively operatively disconnected from the drive shaft when the override means such as the release member is actuated. This may be accomplished by means of an actuating shaft established in relationship to the drive shaft and preferably concentrically located within the drive shaft. In this latter embodiment, the drive shaft itself would be hollow, that is, provided with an axially extending central bore. Consequently, the drive wheel could be effectively mounted for rotation on the drive shaft but displaced by axial displacement of the actuating shaft within the drive shaft itself. Thus, when the release mechanism is actuated, the actuating shaft would be displaced axially and thereby displace the drive wheel away from one end of the drive shaft to permit uncoupling therefrom.

In another embodiment of the invention, the release member may be manually operable as aforesaid and may be located on one side of the housing with respect to the drive wheel. Thus the drive wheel will be located on the other side of the housing out of the way of the manually operable release member. This as advantageous in that it provides a safety feature such that the user of the apparatus attempting to operate the manually operable override means would not have his hand in the same position as a rotating drive wheel or drive chain. Moreover, by locating the drive wheel on one side of the housing with respect to the release means, the construction is greatly simplified and in addition, cost of construction is substantially reduced. This is all enabled by the use of the drive shaft and the concentrically located actuating shaft which is capable of being axially shiftable within the drive shaft to axially displace the drive wheel.

The release member preferably comprises a disc with first and second camming surfaces. In one preferred embodiment one camming surface is located on one side of the disc and the other camming surface is located on the second side of the disc. The first camming surface is adapted to cause the locking mechanism to open when the disc is rotated to the release position. The second camming surface is adapted to cause an axial displacement of the actuating rod to thereby operatively disconnect the drive wheel from the drive shaft, when the release disc is shifted to the override position.

The two camming faces are designed so as to cooperate with each other. The first cam surface has a relief or depth which is approximately twice that of the second. Consequently, when the camming disc is rotated, the total mount of displacement of the camming disc itself is only approximately equal to that of the depth of the second cam. In other words, if the first camming surface has a depth or relief of approximately one-half inch and the second camming surface has a relief of approximately one-fourth inch, in combination, the total disc may only be displaced by one-fourth of an inch. Nevertheless this displacement is effective to cause both the uncoupling of the drive wheel from the the drive shaft and substantially simultaneously open the locking mechanism.

This invention possess many other advantages and has other purposes which may be made more clearly apparent from a consideration of the forms in which it may be embodied. These forms are shown in the drawings forming and accompanying part of the present specification. They will now be described in detail for the purposes of illustrating the general principals of the invention, but it is to be understood that such detailed descriptions are not to be taken in a limiting sense.

BRIEF DESCRIPTION OF THE DRAWINGS

Figure 1:
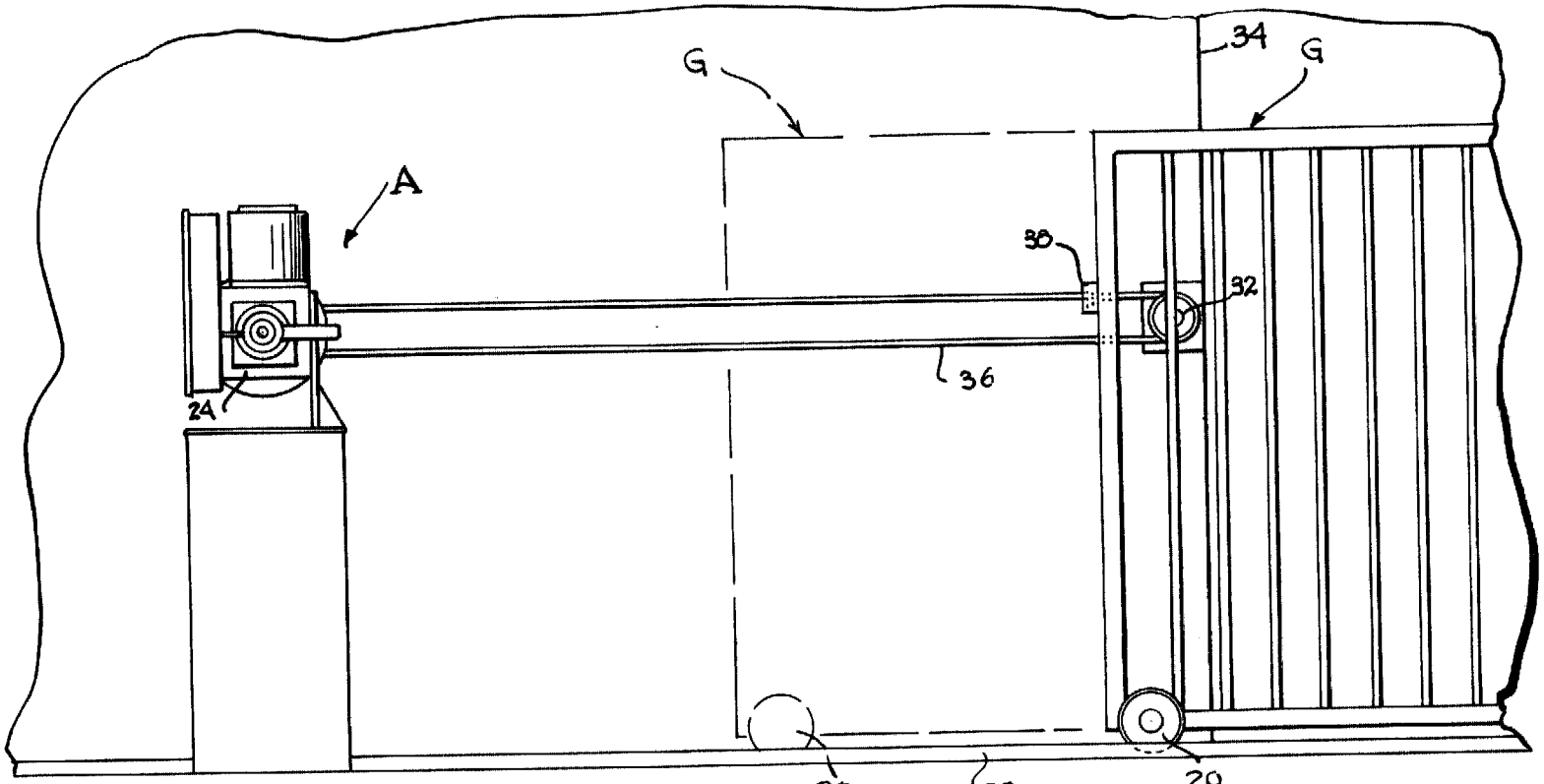
Figure 2:
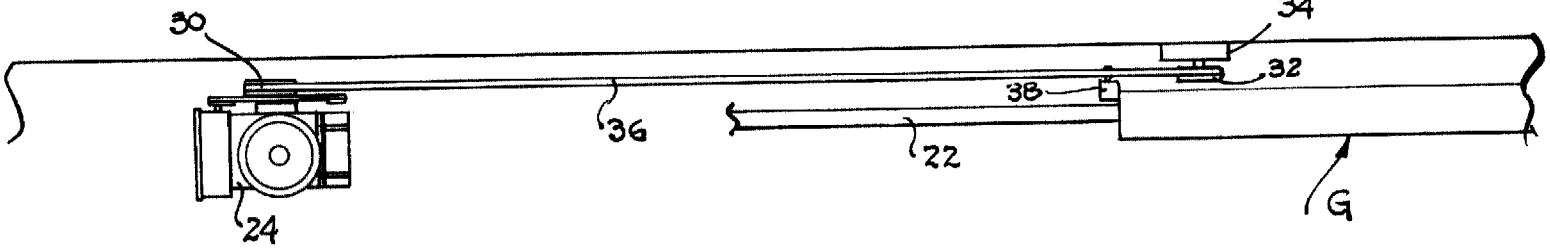
Figure 4:
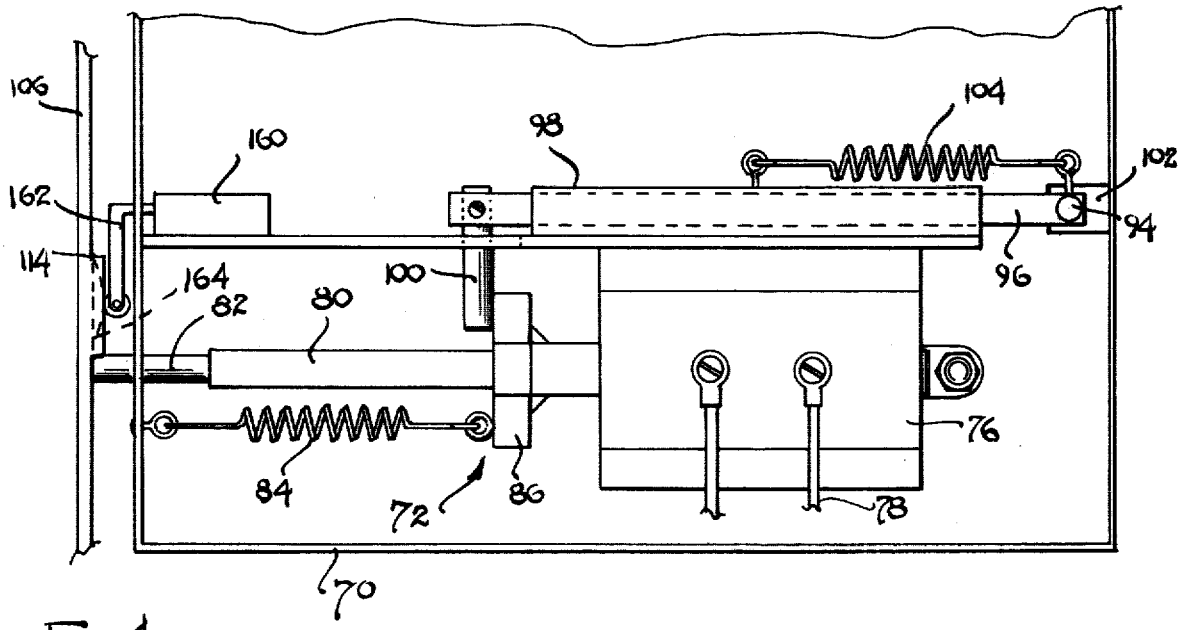
Figure 3:
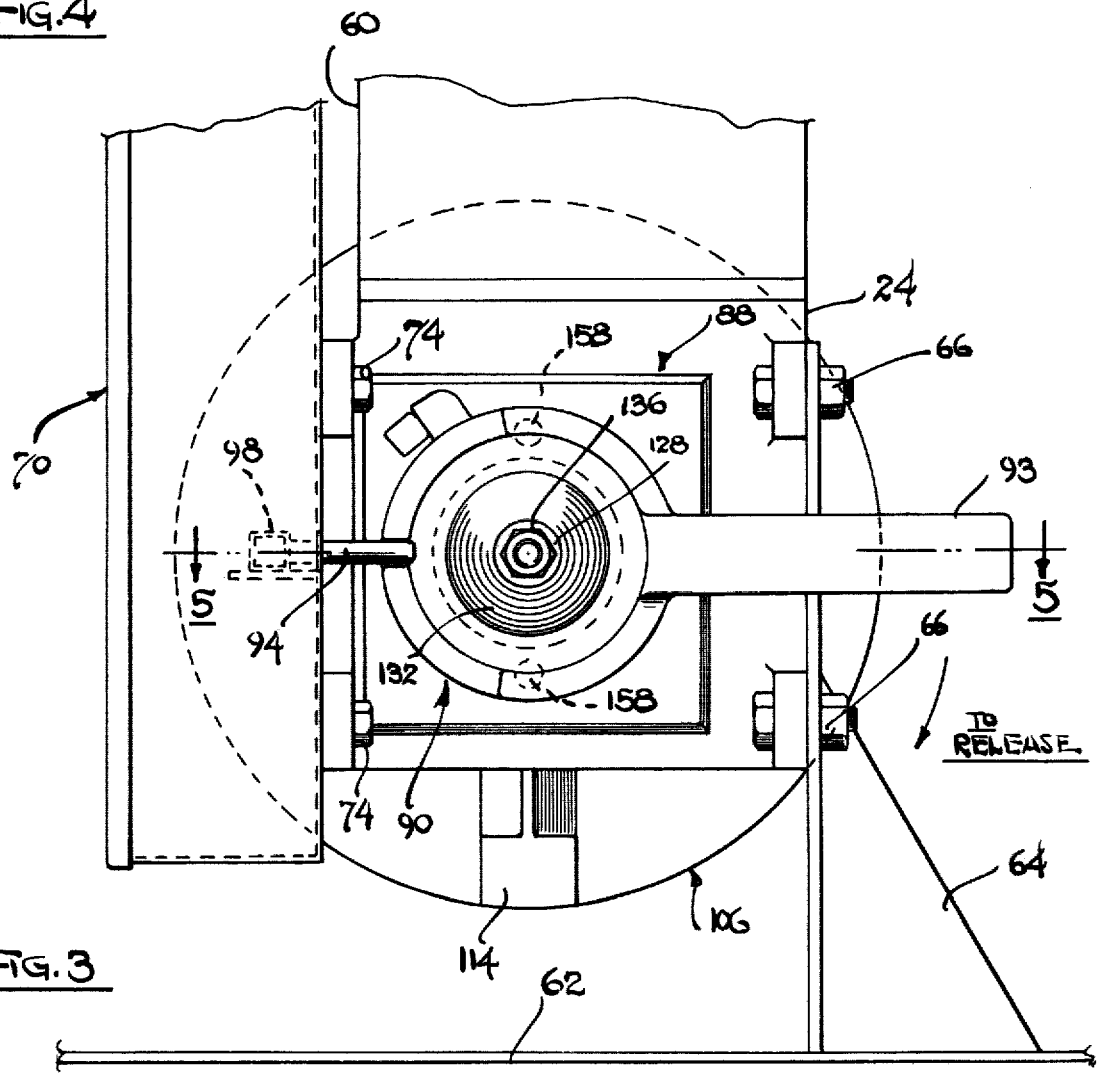
Figure 5:
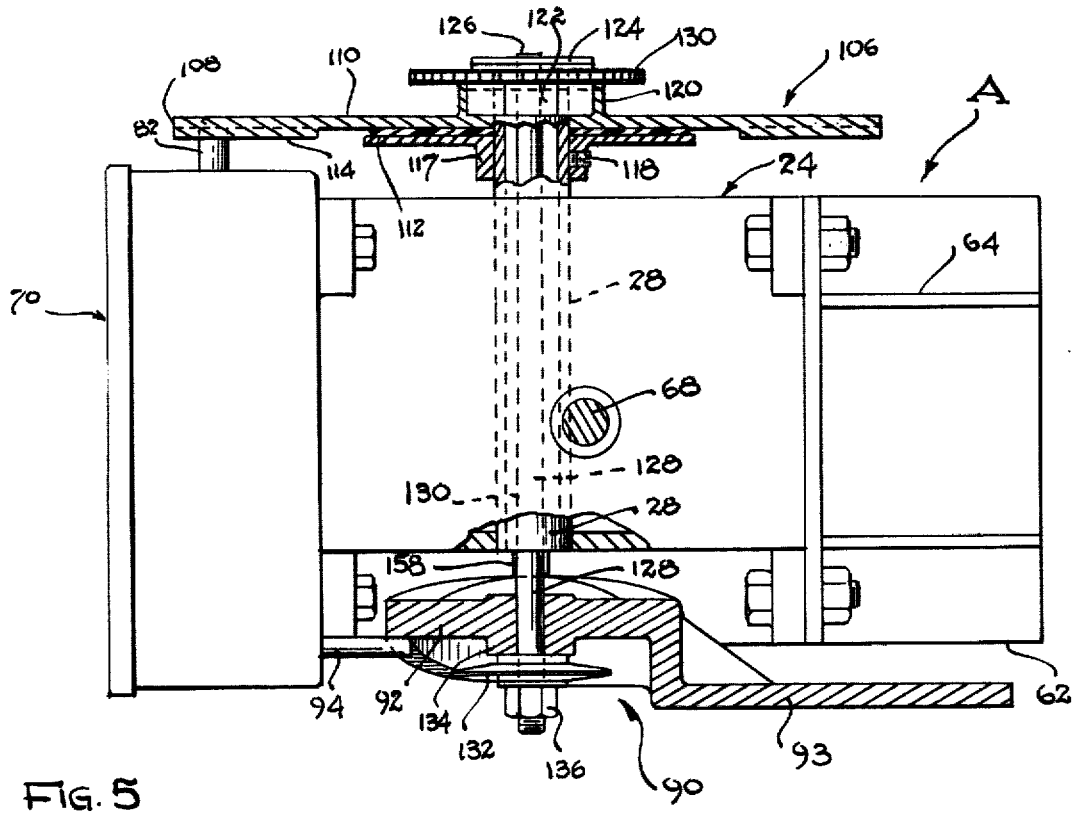
Figure 6:
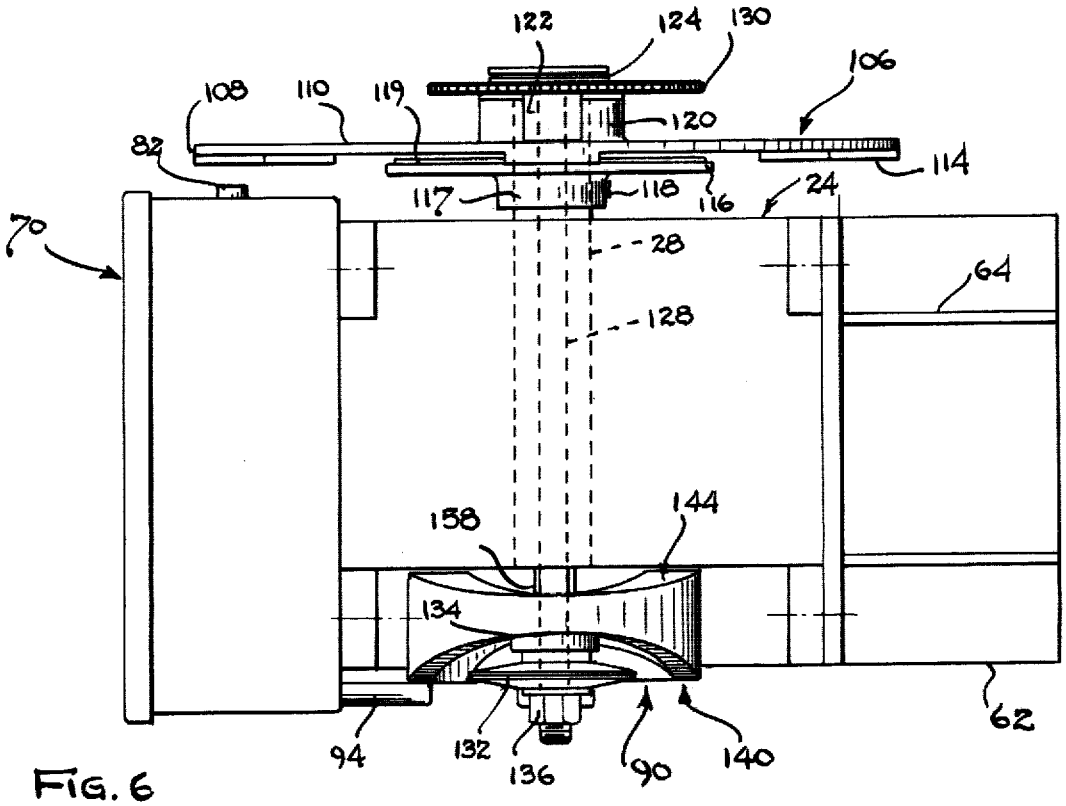
Figure 7:
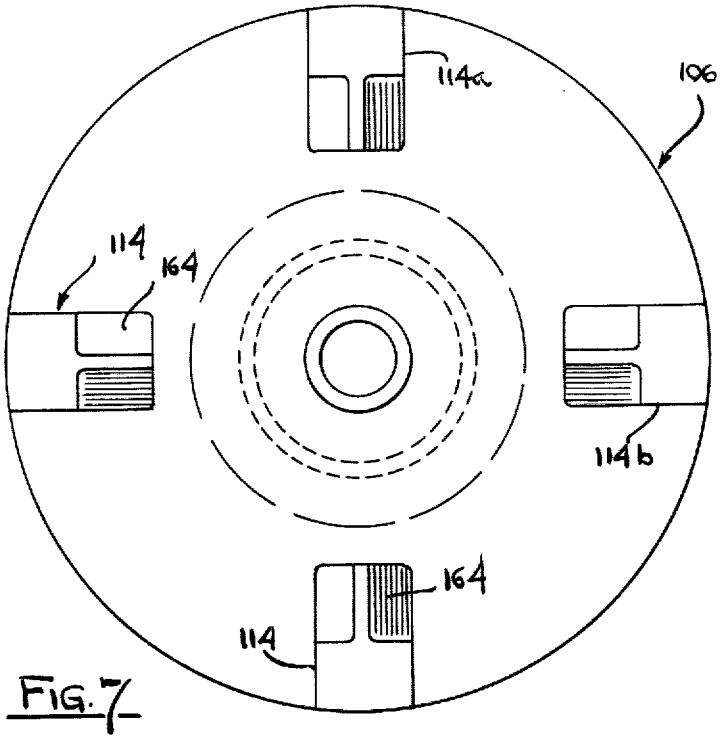
Figure 8:
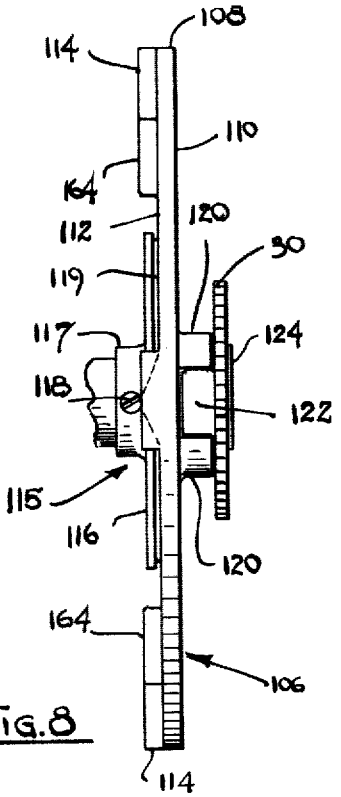
Figure 9:
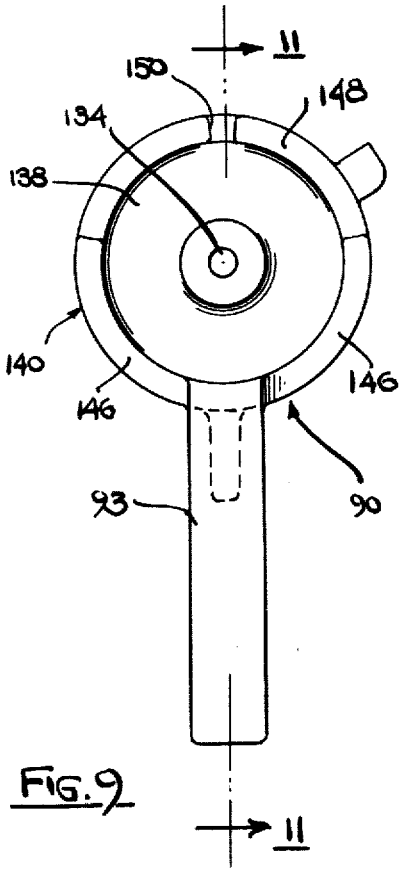
Figure 11:
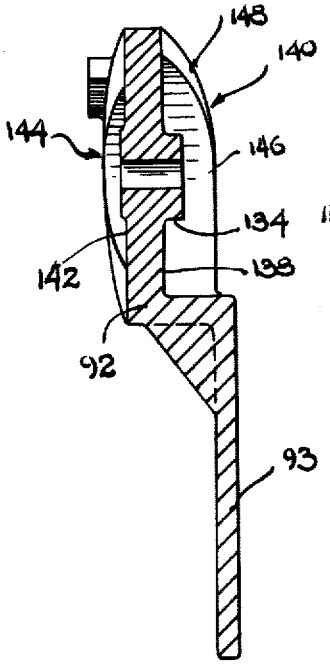
Figure 10:
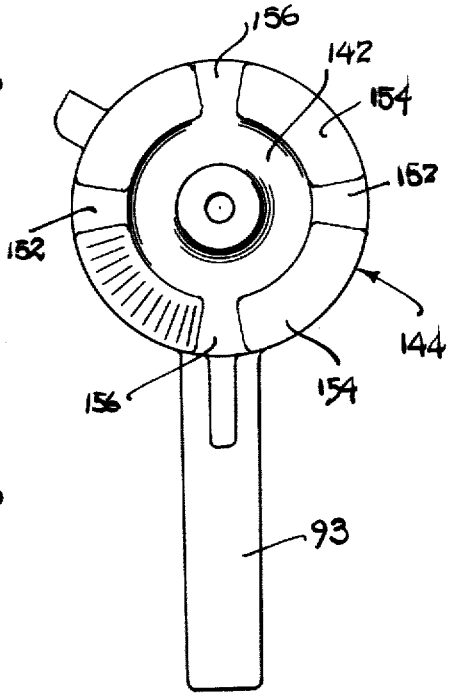

Having thus described the invention in general terms, reference will now be made to the accompanying drawings (five sheets) in which:

FIG. 1 is a framentary side-elevational view showing a gate opening apparatus constructed in accordance with and embodying the present invention and shown connected to a gate movable in a linear path;

FIG. 2 is a top-plan view of the apparatus of FIG. 1, along the the shiftable gate;

FIG. 3 is a front elevational view, partially broken away, of the gate opening and closing apparatus constructed in accordance with and embodying the present invention;

FIG. 4 is an end elevational view showing a portion of a locking mechanism forming a part of the apparatus of the present invention;

FIG. 5 is a top plan view, partially broken away and in section, and showing a portion of the drive mechanism and the manually operable release mechanism forming part of the apparatus of the present invention;

FIG. 6 is a top plan view, partially broken away and similar to FIG. 5, and showing the release mechanism in a position where a drive wheel has become disengaged from the drive shaft, and where the locking means has been shifted to the unlocked position;

FIG. 7 is a side elevational view of one side of a drive wheel forming part of the apparatus of the present invention;

FIG. 8 is an end elevational view of the drive wheel illustrated in FIG. 7;

FIG. 9 is a front elevational view of a manually operable release member forming part of the release mechanism of the present invention;

FIG. 10 is a rear elevational view of a release member of FIG. 9;

FIG. 11 is a vertical sectional view taken along line 11—11 of FIG. 9; and

Figure 12:
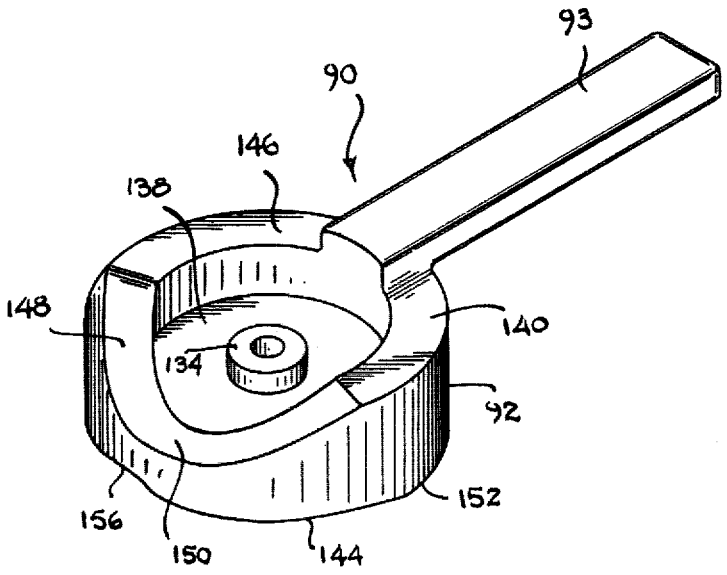

FIG. 12 is a perspective view of the release member forming part of the apparatus of the present invention and showing several of those features illustrated in FIGS. 9-11.

DETAILED DESCRIPTION

Referring now in more detail and by reference characters to the drawings which illustrate a practical embodiment of the present invention, A designates a gate opening and closing apparatus shown in operative connection to a shiftable gate G. In this case, the gate G is shiftable from a closed position across an access opening to an opened position and from the opened position to the closed position by means of the apparatus A. The gate G may be of any conventional construction and, as such, does not form part of the present invention per se. The gate G is conventionally provided with rollers 20 and which are movable along a trackway 22, the latter of which is disposed on the ground or other supporting surface.

In essence, gates of this type are typically used in security apartment buildings and similar commercial establishments and dwelling structures. The access opening permits passage of either people or vehicles, and the gate can be shifted from the closed to the opened position for such access. Generally, many of the commercially available prior art gate opening and closing assemblies operate on the basis of a radio frequency receiver-transmitter system, such that the party desiring to open the gate will actuate the transmitter to generate a signal which, in turn, causes the receiver to energize a motor for shifting the gate G. In essence, the transmitter-receiver system operates as a switch and, in this respect, the present invention can be used in the absence of a conventional radio frequency operated transmitter-receiver system. Thus, for example, a simple key operated switch or the like could be used.

As used herein, the term "gate" is used in its generic sense to include doors and like structures, and essentially constitutes any movable framework or structure which controls the entrance or exit through an access opening to provide passageway.

The apparatus A comprises a rectangular housing 24 which may be formed of any suitable sheet metal or the like and which may be secured to a wall 26 which may form one of a pair of spaced apart fixed barriers which define the access opening. Nevertheless, the housing 24 can be mounted in any suitable location. The housing 24 is provided with a forwardly extending drive shaft 28 which extends outwardly of the housing 24. Mounted on the outer end of the drive shaft 28 and being rotatable therewith is a drive sprocket 30 which serves as a driving wheel.

The drive sprocket 30 cooperates with an idler sprocket 32 which is mounted on a fixed or stationary structure, such as a wall, and preferably near the edge of the wall where the gate is located at the access opening. In this arrangement the gate would move to the open position by being shifted adjacent to and parallel to said wall. By reference to FIGS. 1 and 2, it can be observed that the idler sprocket 32 is located near the edge of a wall 34 which defines one of the limits of the access opening for the gate. Trained around the drive sprocket 30 and the idler sprocket 32 is a continuous drive chain 36. In this case, it should be understood that drive pulleys and a drive belt could be substituted for the sprocket and chain arrangement, if desired, although the drive sprockets and drive chain arrangement is preferred. One portion of the chain 36 is affixed to the gate by means of a fitting 38 on the gate. In this case, it can be observed that the fitting 38 is located on the upper side of the drive chain 36 as opposed to the lower side thereof.

In accordance with this construction, when the drive sprocket 30 is rotated so as to cause the chain 36 to rotate in a counter-clockwise direction, the gate G will be shifted from the closed position, that is closed across the access opening, to the opened position such that the gate G will shift to the left, reference being made to FIGS. 1 and 2. When the gate reaches the opened position, the motive means within the apparatus A will be de-energized thereby ceasing rotation of the drive shaft 28 and drive sprocket 30. In order to close the gate, the gate will be shifted to the right. Consequently, the drive sprocket, and hence the chain 36 will be driven in the clockwise direction. tension will thereupon be introduced into the lower portion of the chain 36 so as to effectively move the gate G to the right, that is, to the closed position.

In each case, it can be observed that in accordance with this arrangement for shifting the gate, that the fitting 38 must always be to the left of the drive sprocket 32 or at least to the left of the vertical center line passing through the drive sprocket 32.

A conventional turn-buckle (not shown) may also be included within the chain 36 in order to adjust the overall size and the degree of tension maintained on the chain 36.

It should be understood that other forms of driving means could be provided for connection to the drive sprocket 30 in order to shift the gate. For example, a pair of lever arms which are connected to the drive sprocket and to the gate could be used and operated by a drive chain which is connected around the drive sprocket and around an idler sprocket at a point of pivotal connection between the two lever arms. One arrangement somewhat similar to this is described in the aforesaid U.S. Pat. No. 4,159,599 dated July, 1979.

As indicated previously, the apparatus may be suitably mounted in any desired location where it is desirably unobtrusive and cannot be reached by one inserting his hand and arm through an opening in the gate. In the embodiment as illustrated, the apparatus is shown as being mounted on a pedestal although it could be secured to a roof, wall or other permanent structure. In any case the apparatus should be mounted so that the release member (hereinafter described) is conveniently available for use.

The apparatus A generally comprises a motive means such as an electric motor 60 which may be suitably mounted on the housing 24. The electric motor may be adapted for operation on conventional household current, such as 110 v. A.C., power. The motor 60 is illustrated as being mounted on the upper end of the housing 24. In addition, the housing 24 itself is secured to a mounting plate or base plate 62 through a gusseted bracket 64 by means of a plurality of bolts 66.

The housing 24 preferably contains a gear drive train so as to translate the rotational power delivered from the motor 60 through a motor output shaft 68 as more fully illustrated in FIG. 5. In this case, the motor output shaft 68 would be connected to the drive shaft 28 through a conventional gearing mechanism (not shown). Typically, a reduction gear train would be located within the drive housing 24.

Also secured to a one flat face of the drive housing 24 is a similar rectangular shaped housing 70 which is designed to hold a locking mechanism 72 as more fully illustrated in FIG. 4 and which housing 70 is thereupon referred to as a lock containing housing or lock housing. The housing 70 may also be suitably mounted to brackets on the drive housing 24 by means of bolts 74.

The locking mechanism 72 generally includes a solenoid 76 which is provided with a pair of conductive leads 78 for connection to a control circuit or otherwise directly to the motor for operation thereof, in a manner as hereinafter described in more detail. The solenoid 76 is designed to operate a locking rod 80 by causing axial shifting movement of the same. At the left-hand end of the locking rod 80 is a diameterally reduced portion 82, often referred to as a "locking pin". When the solenoid 76 is energized, the locking rod 80 will be pulled to the right into an unlocking position or so-called "open position". However, when the solenoid is not energized, the locking rod 82 will be pulled to the left which constitutes a locking position, by means of a spring 84. By reference to FIG. 4, it can be observed that the spring 84 is located so as to be attached to the housing 70 as well as to an enlarged head 86 on the locking rod 80. Thus, the locking rod will be biased to the locking position against the action of the solonoid 76.

The apparatus is provided with an override means 88 more fully illustrated in FIGS. 3, 5 and 6 of the drawings. The override means 88 is comprised of a manually operable release member 90, the latter being comprised of a generally cylindrically shaped disc 92 having an integrally formed outwardly extending engageable handle 93. The release member 90 is operable to engage a lock release pin 94 extending outwardly of the lock housing 70 in the manner as illustrated in FIGS. 3, 5 and 6. Moreover, the lock release pin 94 is connected to a shiftable bar 96 located within the bore of a rectangularly shaped guide 98, reference being made to FIG. 4 of the drawings. At the left-hand end of the shiftable bar 96 is a depending engagement pin 100 which is adapted to engage the enlarged head 86 on the locking rod 80.

In accordance with the above-outlined construction, when the release member 90 is rotated, in a manner to be hereinafter described in more detail, it will cause the lock release pin 94 to shift to the right in a slot 102 formed in the lock housing 70, reference being made to FIG. 4, this action will, in turn, cause the locking rod 80, and hence the locking pin 82 to be shifted to the right and hence to the unlocked position. The release member 90 is effective when manually rotated to pull the shiftable bar 96 to the right against the action of a spring 104 which is connected to the guide 98 and the lock release pin 94. Moreover, the lock is again opened against the action of the tension spring 84 which tends to pull the locking rod 80 to the left or to the locked position.

The locking rod 80, and particularly the locking pin 82 is engagable with a locking wheel 106 and which is also mounted on the drive shaft 28 in proximity to the drive sprocket 30 and which is releasably engagable with the drive sprocket 30, in a manner to be hereinafter described in more detail. The locking wheel 106 thereby forms part of an assembly with the driving sprocket 30 inasmuch as it is rotatable with the sprocket 30 and hence the combination of the locking wheel 106 and the drive sprocket 30 are often referred to as a "driving wheel."

The locking wheel 106 is preferably constructed in the form of a flat circular plate 108 and is more fully illustrated in FIGS. 7 and 8 of the drawings. The circular plate 108 is provided with an outwardly presented face 110 and an inwardly presented face 112, the latter of which faces the gear housing 24. On the inwardly presented face 112, the plate 108 is provided with a plurality of circumferentially spaced apart inwardly extending lugs 114 which are adapted to be engaged by the locking pin 82. In the embodiment of the invention as illustrated, four such lugs 114 are provided, although it should be understood that any number of lugs could be provided on the inwardly presented face 112. When the locking pin 82 is shifted to the locking position, as illustrated in FIG. 4 of the drawings, the pin will be engagable with the sides of any of the lugs 114. Thus, the pin, when shifted to the locking position, may be located between two of the lugs designated as **114*a* and 114*b*, and thus the pin can only permit the locking wheel 106 to rotate slightly less than 90° between these two locking lugs 114*a* and 114*b*, but which will not be sufficient to open the gate. The locking wheel 106 actually forms part of a clutch mechanism 115, including a clutch plate 116 which is provided with an integrally formed hub 117 for securement to the drive shaft 28 by means of a set screw 118. On its outwardly presented surface, the clutch plate 116 is provided with a clutch layer 119, the latter presenting a high frictional contact surface which is capable of engaging the inwardly presented face 112 of the locking wheel 106**.

In accordance with the above-outlined construction, it can be observed that the clutch plate 116 and the locking wheel 106 function as the two major elements of the clutch 115. When the locking wheel 106 is axially displaced from the clutch plate 116, and particularly, the layer 119 thereof, as hereinafter described in more detail, the clutch 115 is effectively disengaged, as illustrated in FIG. 6. Contrariwise, when the clutch plate 116 and the locking wheel 106 are in contact, as illustrated in FIG. 5, the clutch is effectively engaged.

The outwardly presented face 110 of the locking wheel 106 is also provided with a plurality of arcuately shaped circumferentially arranged flanges 120 which are located in a circular array to form an effective cup-shaped socket. The various flanges 120 are spaced apart from each other with spaced apart openings, and which openings are adapted to receive similar circumferentially spaced apart flanges 122 on the inwardly presented surface of the drive sprocket 30 snuggly fit in the spaces between the flanges 120 on the locking wheel 106 to form a secure locking action between the locking wheel 106 and the sprocket 30. This means of securement is effective due to the fact that the sprocket and locking wheel are formed of different metals. Moreover, this coupling is effective to permit the drive sprocket 30 to always be rotated with the locking wheel 106. The locking wheel 106 is disposed on the drive shaft 28 but can be rotatable independently thereof when not in contact with the clutch plate 116 and is rotatable therewith when the two are coupled together. This construction also permits the drive sprocket 30 and the locking wheel 106 to be laterally or axially displaced from the clutch plate 116.

A washer 124 is located on the outer surface of the sprocket 30 and a bolt or a screw 126 extends through the washer 124 and the drive sprocket 30 for locking the same to an actuating shaft 128, the latter being concentrically disposed within a central bore 130 of the drive shaft 28. Thus, it can be observed that the drive sprocket 30 and the locking wheel 106 will be effectively retained on the drive shaft 28 to be rotatable therewith, but which also permits the drive sprocket 30 and locking wheel 106 to be axially displaced from the clutch plate 116 as aforesaid, and thereby uncoupled from the drive shaft 28.

In accordance with the above-outlined construction, it can be observed that when the locking pin 82 is extended, it will engage the locking lugs 114 thereby preventing rotation of the locking wheel 106, and hence, the drive sprocket 30 when coupled to the clutch plate 116. In like manner, when the locking rod 80 is retracted to the open position, free rotation of the locking wheel 106, and hence the sprocket 30, is permitted. Moreover, inasmuch as the sprocket 30 and the locking wheel 106 are coupled to the drive shaft 28, through the clutch mechanism 115, rotation of the drive shaft 28 will also cause rotation of the drive sprocket 30 and an opening or closing of the gate G, in the manner as heretofore described.

The actuating shaft 128 extends axially within the bore 130 of the drive shaft 28, as aforesaid. The drive shaft 28 rotates independently of the actuating shaft 128, but the drive shaft 28 is not axially displaceable. However, while the actuating shaft 128 does not rotate, it is axially displaceable within the central bore 130 of the drive shaft 28. The actuating shaft 128 also extends through the cylindrically shaped disc 92 of the release member 90, in the manner as illustrated in FIGS. 5 and 6. At its outer end, a bellville type spring washer 132 is located over the actuating shaft 128 and bears against a flat hub 134 integrally formed with and extending outwardly on the disc 92. A locking nut 136 is secured to an other threaded end of the actuating shaft 128 to thereby hold the bellville spring washer 132 in place. The bellville spring washer 132 functions as a type of spring and is generally comprised of a pair of cup-shaped discs which are abutted together and are capable of being compressed to thereby act as a compression spring when so compressed.

The release member 90 is more fully illustrated in FIGS. 9–12 of the drawings and comprises the disc 92 along with a handle 93 and the hub 134, as aforesaid. The disc is provided on its outwardly presented face 138 with a caming surface 140 and is similarly provided on its inwardly presented face 142 with a caming surface 144, and both camming surfaces are hereinafter described in more detail.

The camming surface 140 generally includes a semicylindrically shaped ridge 146 extending from the handle 93 and merging into downwardly and arcuately converging slopes 148 which, in turn, merge into a low-point 150, the latter being diametrally opposite the handle 93. In the preferred embodiment of the handle, the drop-off to the low-point 150 from the ridge 146 is approximately one-half inch.

The cam 144 on the inwardly presented surface 142 of the disc 92 is more fully illustrated in FIG. 10 and is provided with a pair of high portions or so-called "high points" 152. These high points 152 are located at 90° on each side of the low point 150 but on the opposite side of the disc. In addition, the high points 152 move through arcuate cam surfaces 154 into a pair of low points 156. By reference to FIG. 10, it can be observed that the low points 156 are so located that one is adjacent to the handle, and the other is spaced apart approximately 180° from the handle 93, that is, diametrially opposite the handle 93. In one of the preferred embodiments of the invention, the drop-off from the high points 152 to the low points 156 is approximately one-fourth inch or approximately one-half of the drop-off from the high ridge 146 to the low point 150 on the cam 140.

In normal operation of the apparatus, that is, in times where there are not emergency conditions, the override mechanism is not used, and hence the release member 90 will remain in the position as illustrated in FIG. 5, such that the sprocket 30 and the locking wheel 106 are coupled to the clutch plate 116, such that they in turn, coupled to the drive shaft 28 so as to be rotatable therewith. Thus, upon receipt of the signal, as for example, a key operated lock, which permits energization of the motor 60, the motor will cause the drive train to cause rotation of the drive shaft 28. Moreover, energization of the motor 60 for causing rotation of the drive shaft 28 will also simultaneously energize the solenoid 76 in order to withdraw the locking rod 80 to the unlocked position. This will permit free rotation of the drive wheel assembly comprised of the drive sprocket 30 and the locking wheel 106. Rotation of the sprocket 30 will cause the gate to open or close in the manner as aforesaid.

In the event of a power failure or other emergency condition, in which the motive means is not operated, or due to some other failure of the apparatus, it is possible to override the apparatus merely by turning the release member 90. In this case, due to the fact that the apparatus A is normally located in a security area, that is, on the inside of a garage or similar location where it is not available to access by the general public, only one who normally has authorization to be in the area will have access to the release member 90.

In order to operate the override mechanism, the release member 90 is turned, in this case, in either a clockwise or counter-clockwise direction. The rotation of the disc 92 forming part of the release member 90 will cause the lock release pin 94 to move out of the low point 150, where it is normally positioned when the apparatus is not in the override mode, to one of the ridge portions 146. As this occurs, and by reference to FIG. 4, it can be observed that the locking rod 80 is pulled rearwardly in the manner as previously described and against the action of the tension spring 84. Consequently, the lock is opened or disengaged from the locking wheel 106.

Simultaneously with the opening of the locking mechanism, the forwardly presented cam 144 will ride upon a pair of projections 158 which extend outwardly from the drive housing 24 in the manner as illustrated in FIG. 3. When the apparatus is not in the override mode, such that the release member 90 is in the position as illustrated in FIGS. 3 and 5, the projections 158 are located at the high points 152 on the caming surface 144. However, when the release member 90 is rotated, the low points 156 will be moved into the position of the projections 158 on the housing. As this occurs, the bellville spring washer 132 will bias the entire release member 90 inwardly toward the housing 24. The biasing of the release member 90 toward the housing, that is toward the sprocket 30, will cause an axial displacement of the actuating shaft 128. As this occurs, the actuating shaft 128 will cause the sprocket 30 and locking wheel to be uncoupled from the clutch plate 116. Consequently, the sprocket 30 and locking wheel 106 can be rotated manually with respect to the drive shaft 28 in order to permit manual opening and closing of the gate. Finally, when the emergency condition is over, as for example, by the restoral of power, the release member 90 can be turned to its initial position so that the apparatus is back in the operating mode.

The apparatus is also provided with a counter 160 more fully illustrated in FIG. 4 and which is provided with a rocker arm 162 for operating the counter.

The rocker arm 162 is operable by means of counting projections 164 located on the interior surface of the locking wheel 106. In this case, the counting projections 164 are mere extentions of the locking lugs 114, as best seen in FIGS. 7 and 8. The counting projections 164 merely include beveled surfaces in the manner as illustrated in order to permit the rocker arm 162 to ride up and down these beveled surfaces. In this way, the counter 160, which is a mechanical counter, can count the number of rotations of the locking wheel and hence of the drive shaft in order to move the gate from the open position to the closed position or from the closed position to the open position.

A control circuit (not shown) would be included in the apparatus in order to control the movement of the gate between the open and closed positions. If the counter counts for example 100 rotations between the opened to the closed position, after the control circuit counts an equal number of 100 counts from the open position back to the closed position, it can automatically de-energize the motor inasmuch as the gate will then be at the closed position.

Thus, there has been illustrated and described a unique and novel gate opening and closing apparatus and method for substantially simultaneously controlling a coupling of a gate to a motor means and a locking means to prevent and permit movement of such gate. This apparatus and method therefore fulfills all of the objects and advantages sought therefor. It should be understood that many changes, modifications, variations, and other uses and applications will become apparent to those skilled in the art after considering this specification and the accompanying drawings. Therefore, any and all such changes, modifications, variations, and other uses and applications which do not depart from the spirit and scope of the invention are deemed to be covered by the invention which is limited only by the following claims.

Having thus described my invention, what I desire to claim and secure by Letters Patent is:

1. An apparatus for shifting a gate from a closed position to an open position and from the open position to the closed position with respect to an access opening, said apparatus comprising:

(a) a housing, (b) motive means associated with said housing, (c) a drive member operatively connected to said motive means and capable of being connected to a gate for causing shifting movement of same, (d) a locking mechanism operatively associated with said drive member and being in engagement with said drive member to prevent same from causing shifting movement of said gate when said motive means is not energized and to prevent shifting movement of said gate even from manual attempt to move said drive member, said locking mechanism also being opened and unengageable with said drive member when said motive means is energized to permit movement of said gate when said motive means is energized, and (e) a manually operable release member operatively connected to said locking mechanism and to said drive member, said release member being effective to prevent engagement between said locking mechanism and said drive member so that said locking member does not prevent shifting movement of said gate, said release member also being simultaneously operable to prevent said drive member from being operable by said motive means when said release member is actuated to thereby override said apparatus and permit easy manual shiftable movement of said gate.

2. The apparatus of claim 1 further characterized in that said apparatus comprises a solenoid operable means operatively connected to a locking pin and forming part of said locking mechanism to control movement of said locking pin pursuant to energization of said motive means.

3. The apparatus of claim 2 further characterized in that said motive means is an electric motor.

4. The apparatus of claim 1 further characterized in that said apparatus comprises a drive shaft operatively connected to said motive means and being rotatable by said motive means, said drive member being operatively connected to said drive shaft and rotatable thereby, said drive member being disconnected from said drive shaft upon actuation of said release member.

5. The apparatus of claim 4 further characterized in that said release member is located on one side of said housing and said drive member is located on the other side of said housing with respect to said release member.

6. The apparatus of claim 1 further characterized in that said release member comprises a disc which has a first camming surface adapted to cause said locking mechanism to open when said disc is rotated upon actuation of said release member, said release member having a second camming surface adapted to cause said drive member to become disengaged from said motive means when said disc is rotated.

7. The apparatus of claim 6 further characterized in that said first camming surface is located on the opposite side of said disc with respect to said second camming surface.

8. The apparatus of claim 4 further characterized in that said drive shaft is a hollow drive shaft having a central bore extending therethrough, and a second shaft extending through said drive shaft and which is shiftable to cause said drive member to become operatively disengaged from said drive shaft upon actuation of said release member.

9. The apparatus of claim 1 further characterized in that said gate is shifted longitudinally across the access opening.

10. An apparatus for shifting a gate from a closed position to an open position and from the open position to the closed position with respect to an access opening, said apparatus comprising:

(a) a housing having a gear means therein,
(b) motive means associated with said housing and connected to said gear means,
(c) a rotatable drive shaft extending through said housing and operatively connected to and driven by said motive means through said gear means,
(d) a rotatable drive member rotatable by said drive shaft and located on one side of said housing and capable of being operatively connected to a gate for shifting same,
(e) a disc operatively mounted on said drive shaft and capable of being coupled to said drive member, said disc being on the same side of said housing as said drive member,
(f) a manually operable release mechanism operatively mounted on said drive shaft on the other side of said housing, said
(g) a locking mechanism operable with said disc and being operable by said release mechanism,
(h) an actuating shaft operatively extending between said release mechanism and said drive member to cause operative disconnection of said drive member from said motive means and to prevent any operation between said locking mechanism and said disc when said release mechanism is manually actuated, and which also permits said drive shaft to drive said drive member when unactuated, said actuating shaft being axially displaceable upon actuation of said release mechanism to axially displace said drive member relative to said drive shaft and said disc and thereby operatively disconnect said drive member from said drive shaft.

11. The apparatus of claim 10 further characterized in that said actuating shaft is concentrically disposed within said drive shaft.

12. The apparatus of claim 11 further characterized in that said drive shaft is hollow and said actuating shaft extends concentrically within said drive shaft and said drive shaft is not axially displacable while said actuating shaft is axially displacable.

13. The apparatus of claim 11 further characterized in that said drive member is a drive sprocket and a chain is connected to said sprocket and to a gate.

14. The apparatus of claim 10 further characterized in that a locking mechanism is operatively associated with said drive member for preventing said drive member from causing shifting movement of said gate when said motive means is not energized and being opened to permit movement of said gate when said motive means is energized, and said manually operable release mechanism is operatively connected to said locking mechanism and to said drive member to substantially simultaneously open said locking mechanism and operatively disconnect said drive member from said motive means when said release mechanism is actuated to thereby override said apparatus.

15. The apparatus of claim 14 further characterized in that said apparatus comprises a solenoid operable means operatively connected to a locking pin and forming part of said locking mechanism to control movement of said locking pin pursuant to energization of said motive means.

16. The apparatus of claim 10 further characterized in that said release mechanism comprises a disc which has a first camming surface adapted to cause said locking mechanism to open when said disc is rotated upon actuation of said release mechanism, said release mechanism having a second camming surface adapted to cause said drive member to become disengaged from said motive means when said disc is rotated.

17. The apparatus of claim 16 further characterized in that said first camming surface is located on the opposite side of said disc with respect to said second camming surface.

18. An apparatus for shifting a gate from a closed position to an open position and from the open position to the closed position with respect to an access opening, said apparatus comprising:

(a) a housing,
(b) motive means associated with said housing,
(c) a drive shaft operatively connected to and driven by said motive means,
(d) a drive wheel mounted on said drive shaft and being rotatable therewith,
(e) a plurality of locking abutments on one surface of said drive wheel,
(f) a locking rod adapted to be shifted to a locking position and to an unlocking position, said locking rod being engagable by one or more of said locking abutments to prevent rotation of said wheel when in the locking position to thereby prevent opening of said gate,
(g) solenoid actuable means to move said locking rod to the unlocking position and out of engagement with said abutments, and
(h) release means operatively associated with said drive shaft to cause axial displacement of said drive wheel and to a position where the locking abutments are not engagable by said locking rod.

19. The apparatus of claim 18 further characterized in that counting abutments are associated with said locking abutments and are located with respect to a counter to count rotations of said drive wheel.

20. The apparatus of claim 19 further characterized in that said counting abutments are on said locking abutments.

21. The apparatus of claim 18 further characterized in that means is associated with said release means to simultaneously shift the locking rod to the unlocking position with the axial displacement of said drive wheel.

22. The apparatus of claim 21 further characterized in that said release means being located on one side of said housing and said drive wheel being located on the other side of said housing with respect to said release means.

23. The apparatus of claim 18 further characterized in that and release means comprising a disc which has a first camming surface adapted to cause said locking rod to shift to the unlocking position to open when said disc is rotated upon actuation of said release means, said release means having a second camming surface adapted to cause said drive wheel to become disengaged from said drive shaft when said disc is rotated.

24. The apparatus of claim 23 further characterized in that said first camming surface is located on the opposite side of said disc with respect to said second camming surface.

25. The apparatus of claim 18 further characterized in that said drive shaft is a hollow drive shaft having a central bore extending therethrough, a second shaft extends through said drive shaft and is shiftable to cause said drive wheel to become operatively disengaged from said drive shaft upon actuation of said release means.

26. An apparatus for shifting a gate from a closed position to an open position and from the open position to the closed position with respect to an access opening, said apparatus comprising:

(a) a housing having a gear means therein, (b) motive means associated with said housing and connected to said gear means, (c) a hollow drive shaft extending through said housing and operatively connected to and driven by said motive means through said gear means, (d) a drive member on said drive shaft and located on one side of said housing and capable of being operatively connected to a gate for shifting same, (e) an actuating shaft extending through said hollow drive shaft, (f) a locking mechanism associated wth said housing and capable of being actuated to permit operation of said drive member and unactuated to prevent operation of said drive member, and (g) a manually operable release dis operatively mounted on said drive shaft on the other side of said housing, said disc having first camming surface adapted to cause said locking mechanism to open when said disc is rotated, said disc having a second camming surface adapted to cause said drive member to become disengaged from said drive shaft when said disc is rotated.

27. The apparatus of claim 26 further characterized in that said first camming surface is located on the opposite side of said disc with respect to said first camming surface.

28. The apparatus of claim 26 further characterized in that an actuating shaft operatively extends between said release disc and said drive member to cause operative disconnection of said drive member from said motive means when said release disc is manually rotated to a second position from a first position and which also permits said drive shaft to drive said drive member when not rotated to the second position, said actuating shaft being axially displaceable upon rotation of said release disc to said second position to axially displace said drive member relative to said drive shaft and thereby operatively disconnect said drive member from said drive shaft.

29. The apparatus of claim 28 further characterized in that said apparatus comprises a solenoid operable means operatively connected to a locking pin and forming part of said locking mechanism to control movement of said locking pin pursuant to energization of said motive means.

30. A method of shifting a gate from a closed position to an open position and from the open position to the closed position with respect to an access opening, said method comprising:

(a) energizing a motive means, (b) causing rotation of a drive shaft in response to energization of said motive means, to cause rotation of a drive wheel and thereby open or close a gate in response to rotation of said drive wheel, (c) withdrawing a locking rod from a locking position to an unlocking position away from said drive wheel upon energization of said motive means and rotation of said drive wheel, and shifting the locking rod to a locking position in engagement with the drive wheel in response to deenergization of said motive means, and (d) overriding said motive means through a manually actuable release mechanism by substantially simultaneously (1) operatively disconnecting the drive wheel from the drive shaft so that energization of said motive means cannot move said gate, and (2) withdrawing the locking rod to the unlocking position so that a manual actuation of said drive wheel will cause movement of said gate between the opened and closed positions.

31. An apparatus for shifting a gate from a closed position to an open position and from the open position to the closed position with respect to an access opening, said apparatus comprising:

(a) a housing, (b) a motive means associated with said housing, (c) a drive member operatively connected to said motive means and capable of being connected to a gate for causing shifting movement of same, (d) a locking mechanism operatively associated with said drive member for preventing said drive member from causing shifting movement of said gate when said motive means is not energized and being opened to permit movement of said gate when said motive means is energized, and (e) a manually operable release disc operatively connected to said locking mechanism and to said drive member to substantially simultaneously open said locking mechanism and operatively disconnect said drive member from said motive means when said release disc is actuated to thereby override said apparatus, said disc having a first camming surface adapted to cause said locking mechanism to open when said disc is rotated upon actuation thereof to a first position said disc having a second camming surface adapted to cause said drive member to become disengaged from said motive means when said disc is rotated to a different position.

32. The apparatus of claim 31 further characterized in that said first camming surface is located on the opposite side of said disc with respect to said second camming surface.

33. An apparatus for shifting a gate from a closed position to an open position and from the open position to the closed position with respect to an access opening, said apparatus comprising:

(a) a housing having a gear means therein, (b) a motive means associated with said housing and connected to said gear means, (c) a drive shaft extending through said housing and operatively connected to and driven by said motive means through said gear means, (d) a drive member on said drive shaft and located on one side of said housing and capable of being operatively connected to a gate for shifting same, (e) a manually operable release mechanism operatively mounted on said drive shaft on the other side of said housing, (f) an actuating shaft operatively extending between said release mechanism and said drive member to cause operative disconnection of said drive member from said motive means when said release mechanism is manually actuated and which also permits said drive shaft to drive said drive member when unactuated, said actuating shaft being axially displaceable upon actuation of said release mechanism to axially displace said drive member relative to said drive shaft and thereby operatively disconnect said drive member from said drive shaft, and (g) a locking mechanism operatively associated with said drive member for preventing said drive member from causing shifting movement of said gate when said motive means is not energized and being opened to permit movement of said gate when said motive means is energized, and said manually operable release mechanism being operatively connected to said locking mechanism and to said drive member to substantially simultaneously open said locking mechanism and operatively disconnect said drive member from said motive means when said release mechanism is actuated to thereby override said apparatus.

34. The apparatus of claim 33 further characterized in that said apparatus comprises a solenoid operable means operatively connected to a locking pin and forming part of said locking mechanism to control movement of said locking pin pursuant to energization of said motive means.

35. The apparatus of claim 33 further characterized in that said actuating shaft is concentrically disposed with respect to said drive shaft.

36. The apparatus of claim 35 further characterized in that said drive shaft is hollow and said actuating shaft extends concentrically within said drive shaft and said drive shaft is not axially displaceable while said actuating shaft is axially displaceable.

37. The apparatus of claim 35 further characterized in that said drive member is a drive sprocket and a chain is connected to said sprocket and to a gate.

* * * * *